United States Patent [19]

Yamada et al.

[11] Patent Number: 4,817,573

[45] Date of Patent: Apr. 4, 1989

[54] FUEL CONTROL DEVICE FOR INTERNAL-COMBUSTION ENGINES

[75] Inventors: Toshihiro Yamada; Hiroyuki Takebayashi, both of Hiroshima; Setsuhiro Shimomura; Yukinobu Nishimura, both of Hyogo, all of Japan

[73] Assignee: Mitsubishi Denki Kabushiki Kaisha, Tokyo, Japan

[21] Appl. No.: 137,585

[22] Filed: Dec. 24, 1987

[30] Foreign Application Priority Data

Dec. 27, 1986 [JP] Japan ..... 61-314569

[51] Int. Cl.[4] ..... F02M 51/00; F02D 41/18

[52] U.S. Cl. ..... 123/494; 123/489; 123/440

[58] Field of Search ..... 123/494, 478, 440, 480, 123/491, 486; 73/118.2, 204; 323/365

[56] References Cited

U.S. PATENT DOCUMENTS

| | | | |
|---|---|---|---|
| 4,334,186 | 6/1982 | Sasayama et al. | 123/494 |
| 4,397,283 | 8/1983 | Komaroff et al. | 123/494 |
| 4,576,039 | 3/1986 | Muto et al. | 123/494 |
| 4,579,098 | 4/1986 | Mattes et al. | 123/494 |
| 4,612,894 | 9/1986 | Satoh et al. | 123/494 |
| 4,683,858 | 8/1987 | Sato et al. | 123/494 |
| 4,741,313 | 5/1988 | Shimomura | 123/494 |

*Primary Examiner*—Raymond A. Nelli

*Attorney, Agent, or Firm*—Bernard, Rothwell & Brown

[57] ABSTRACT

A fuel control device for internal-combustion engines in which a proper correction value is calculated from the contents of memories corresponding to adjacent representative points, meeting every condition of the amount of mixture drawn in, by selecting representative points to represent the tendency of a flow-dependency characteristic change of intake sensor output, thereby obtaining a proper correction value in a region where the negative feedback of air-fuel ratio is controlled as well as in a region where the negative feedback can not be controlled.

4 Claims, 5 Drawing Sheets

FUEL CONTROL DEVICE FOR INTERNAL-COMBUSTION ENGINES

BACKGROUND OF THE INVENTION

1. Field of the Invention

The present invention relates to a fuel control device for internal-combustion engines and, more particularly, to a fuel control device which enables the correction of a change with time in a hot-wire intake sensor used for fuel control thereof.

2. Description of the Prior Art

A hot-wire intake sensor used in an internal-combustion engine is subjected to a characteristic change caused by deposits of substances on the surface of a hot wire, resulting in such problems as an error in the quantity of fuel fed into the engine, degraded exhaust gases, and in lowered operation performance.

To cope with such problems one practice has been to heat the hot wire up to temperatures over a normal working temperature while the engine is at a stop, in an attempt to burn off the deposits on the hot-wire surface.

A method of this burn-off is described in Laid-Open Japanese Patent No. Sho 54-76182.

It, however, has become clear that performing the burn-off with appropriate frequency is not sufficient to remove the deposits completely, and, moreover, a characteristic change is accumulated, giving an adverse effect to an exhaust gas level and operation performance. That is, there is such a disadvantage that, of components attaching on the hot wire, a substance which is noncombustible at a burn-off temperature accumulates with the lapse of operating time, thereby promoting a change in the characteristic of the intake sensor.

SUMMARY OF THE INVENTION

The present invention has been accomplished in an attempt to solve the aforementioned problems, and has as its object the provision of a fuel control device capable of properly correcting a characteristic change which depends on fuel flow rate, thus constantly insuring satisfactory fuel control.

The fuel control device of the present invention comprises memories corresponding to a plurality of representative points of intake sensor output; a means to write in corresponding memories the amount of correction of air-fuel ratio negative feedback or an amount related thereto, when the intake sensor output is in the vicinity of the representative points; and a control means for correcting the basic controlled variable of fuel, using values obtained by interpolation operation or extrapolation operation from the intake sensor output and the contents of memories corresponding to representative points adjacent to this output.

Other objects and advantages of the present invention will become more apparent from the following detailed description of the preferred embodiment taken in connection with the accompanying drawings, wherein:

DESCRIPTION OF THE PREFERRED EMBODIMENTS

Figure 1:
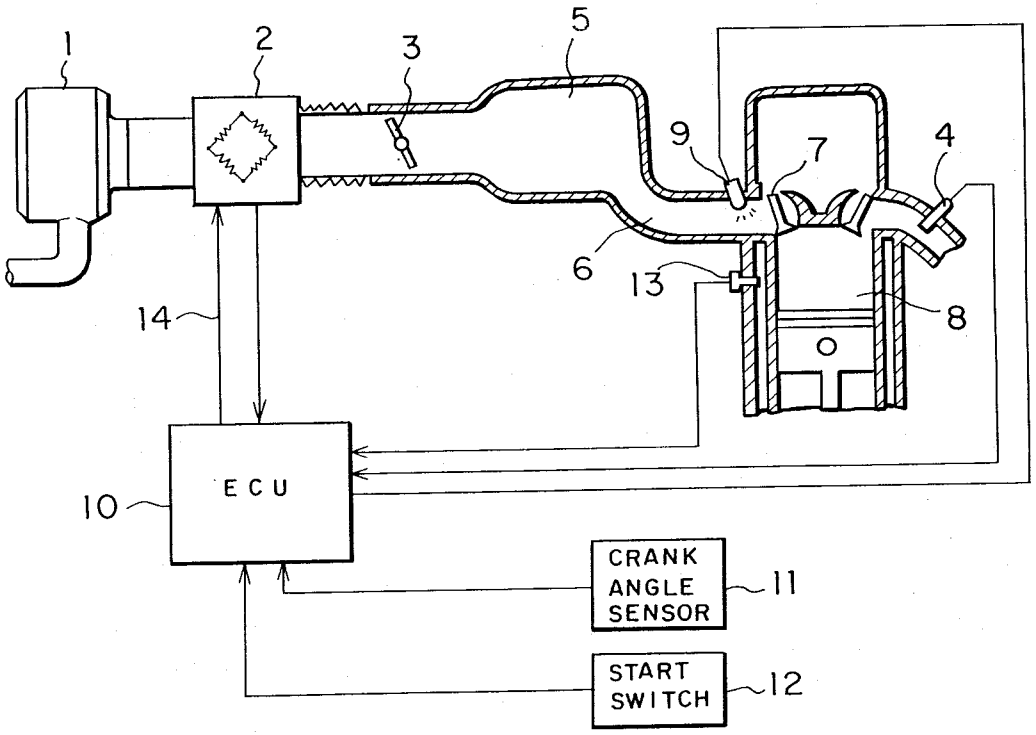
FIG. 1 is an explanatory drawing showing one embodiment of a fuel control device for internal-combustion engines of the present invention.

Preferred embodiments of the present invention will now be described by referring to the accompanying drawings. FIG. 1 is a block diagram showing the constitution of its one embodiment, in which the constitution of the fuel control device using a hot-wire intake sensor (hereinafter termed AFS) which senses the quantity of air drawn into the engine is illustrated.

In FIG. 1, 1 designates an air cleaner, 2 AFS, and 3 a throttle valve for controlling the quantity of mixture taken into the engine.

From a surge tank 5 extends an intake manifold 6, which is connected to a cylinder 8. The cylinder 8 has an intake valve 7 which is driven by a cam not illustrated.

As regards the cylinder 8, only one cylinder of the engine is illustrated for the purpose of simplification of the drawing; actually, however, the engine has a plurality of cylinders.

Each cylinder 8 is provided with a fuel control valve 9 (hereinafter termed the injector). The amount of fuel injected from this injector 9 in relation to the quantity of mixture drawn into each cylinder 8 is controlled by ECU10 (electronic control unit) in order to obtain a specific air-fuel (A/F) ratio. Numeral 4 is an $O_2$ sensor for the negative feedback of air-fuel ratio.

ECU10 determines the amount of fuel injected on the basis of signals from AFS2, a crank angle sensor 11, start switch 12, engine cooling water temperture sensor 13 and the $O_2$ sensor 4, and control the pulse width of fuel injected from the injector 9 simultaneously with a signal from the crank angle sensor 11.

ECU10, after stopping the feedback, produces and sends a burn-off control signal 14 to AFS2, and heats up the hot wire of AFS over the normal operating temperature, thus burning off the deposits on the surface to recover the initial characteristics of the hot wire surface. The constitution of operation ofo this burn-off control device are the same as those of known arts and therefore detailed description thereof is omitted.

Figure 2:
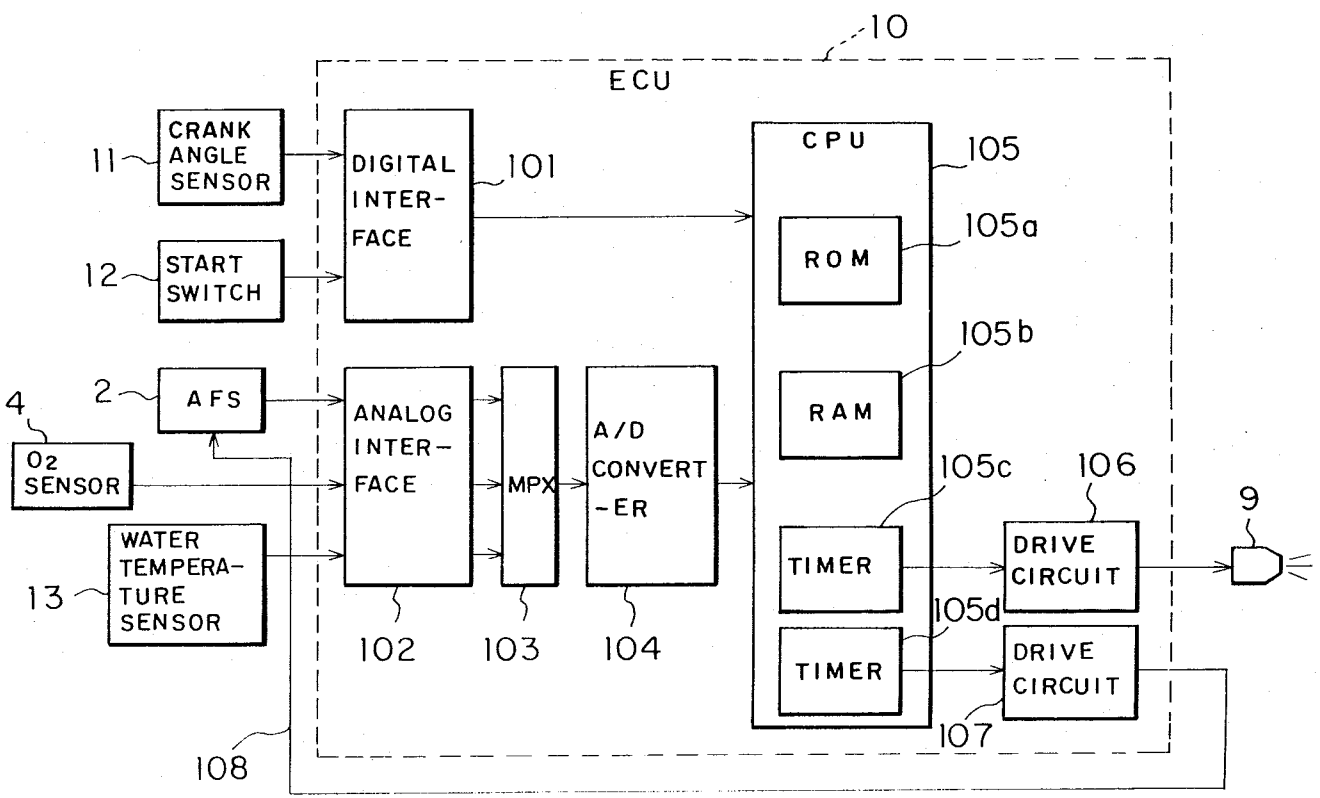
FIG. 2 is a block diagram showing the internal constitution of an electronic control unit (ECU) in the fuel control device of FIG. 1.

FIG. 2 shows the internal constitution of ECU10; 101 designates an interface circuit for the digital input of the crank angle sensor 11 and the start switch 12, and 102 an interface circuit for the analog input of AFS2, the cooling water temperature sensor 13 and the $O_2$ sensor 4.

Numeral 103 designates a multiplexer, and analog inputs from AFS2, the cooling water temperature sensor 13 and the $O_2$ sensor 4 are converted in succession by an A/D (analog/digital) converter 104.

CPU105 has ROM105*a*, RAM105*b* and timers 105*c* and 105*d* which are built inside. It is designed to calculate injector driving pulse width in accordance with a program stored in ROM105*a* on the basis of signals input from the aforesaid interface circuit 101 and the A/D converter 104, and to output a pulse of a specific time width through the timer 105*c*.

This pulse is amplified by a driving circuit 106, which in turn drives the injector 9. The above-mentioned constitution pertaining to fuel control is a known art and therefore its detailed description is omitted here.

A drive circuit 107 is driven by the output of the timer 105*d*, and AFS2 is driven by its output 108.

Figure 3:
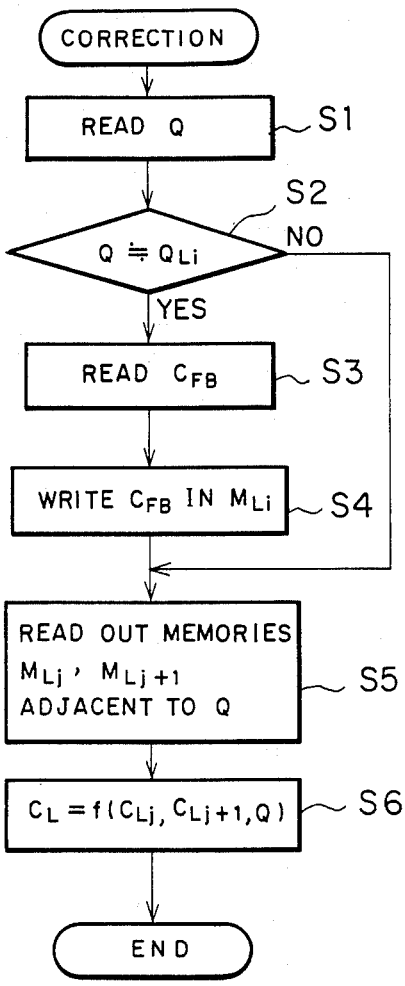
FIG. 3 is a flowchart showing an example of execution of a program of the electronic control unit (ECU) in the fuel control device of the present invention.

Subsequently, a method for correction operation will be described, using the flowchart of FIG. 3. FIG. 3 shows the flow of operation for the correction of a characteristic change in the intake sensor; other flowcharts of fuel control are omitted.

In this drawing, an intake sensor output Q is read at Step S1, and compared at Step S2 to see whether it is equal to a predetermined output of the intake sensor, that is, a representative value QLi of the flow rate Q. The representative value QLi has been selected as a flow rate possible to represent a characteristic change in the intake sensor.

Figure 4:
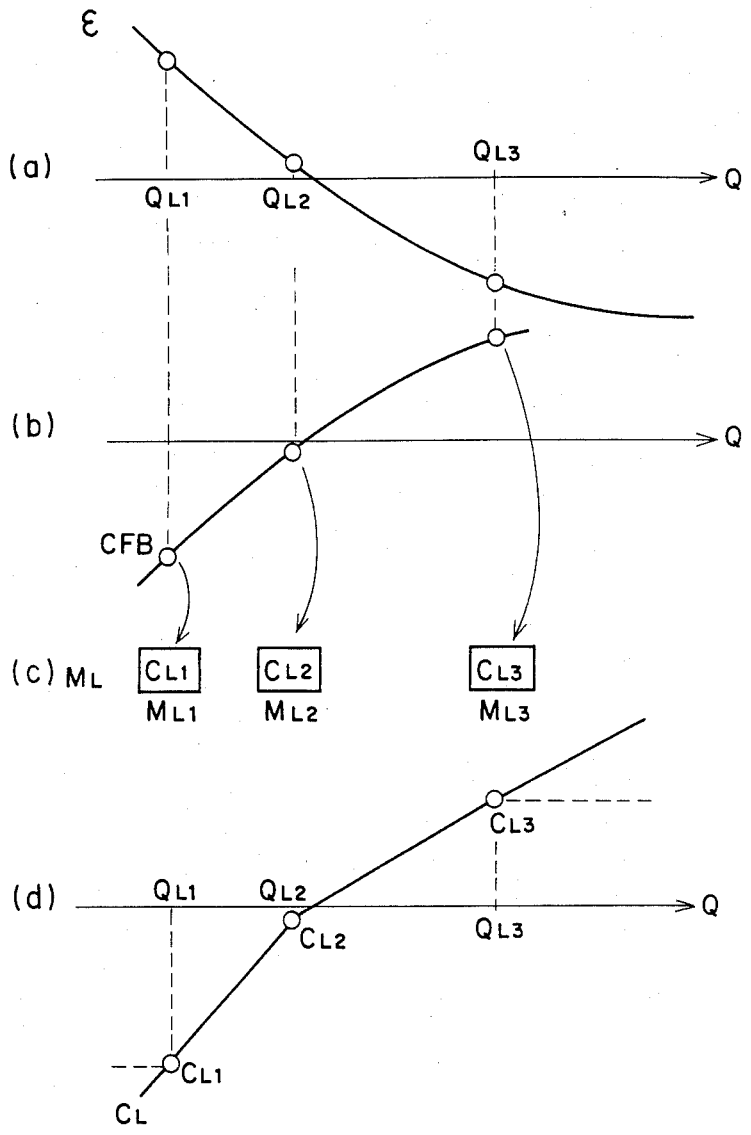

In FIG. 4, (a) is a flowchart showing a characteristic change $\epsilon$ in which three points of QL1, QL2 and QL3 are selected as the representative value QLi.

In the selection of the representative points, QL1 is selected when the characteristic change is within the positive region; QL3 when the characteristic change is within the negative region; and QL2 when the characteristic change is within a region in which a tendency is changed from positive to negative, thereby obtaining a correct value of correction at as small a number of representative points as possible.

When the flow rate Q is nearly equal to the representative value QLi, the processing proceeds to Step S3, reading the amount of air-fuel ratio negative feedback CFB.

The amount of air-fuel ratio negative feedback CFB is a coefficient for the negative feedback correction of the basic controlled variable by the $O_2$ sensor such that the air-fuel ratio will be matched to the target value, making a comparison output given by comparing the output of the $O_2$ sensor 4 correspond to an output obtained through the proportion and integral processing. Since it is an art of public knowledge, detailed description is omitted here; however, as shown at (b) in FIG. 4, CFB acts to cancel the characteristic change $\epsilon$ of the intake sensor 4 as shown at (b) in FIG. 4.

Next, a value CLi (CFB or a value related thereto) which has been read at Step S3 is written in a memory MLi set corresponding to a representative value CLi at Step S4. The memory MLi to be used is desired to be a nonvolatile memory.

When, at Step S2, the flow rate Q is not equal to the representative value QLi, the processing at Steps S3 and S4 is not executed, but proceeds to Step S5.

At Step S5, contents CLj, CLj+1 of the memories MLj, MLj+1 corresponding to the output values QLj, QLj+1 adjacent to the value of the present intake sensor output Q are read out, and then a correction value CL corresponding to the present flow rate Q is determined by interpolation (extrapolation) operation at Step S6. One example of this interpolation (extrapolation) operation will be described with reference to (d) in FIG. 4. When the flow rate Q is smaller than QL1, a straight line CL connecting CL1 and CL2 which connect the contents of the memories ML1, ML2 corresponding to the flow rate QL1, QL2 is produced.

When the flow rate Q is greater than QL2, a straight line CL is similarly determined to connect between the contents CL2 and CL3 of the memories ML2, ML3.

When the flow rate Q is less than QL1 or greater than QL3, the content CL of the memory may be set as CL=CL1 or CL=CL3 as indicated by a broken line.

The content CL of the memory thus obtained takes a form of a function nearly equal to the amount of air-fuel ratio negative feedback CFB indicated at (b) in FIG. 4; therefore, correcting the basic controlled amount of fuel by the content CL of this memory can remove an error caused by the characteristic change of the intake sensor, thereby obtaining a good fuel control condition.

Figure 5:
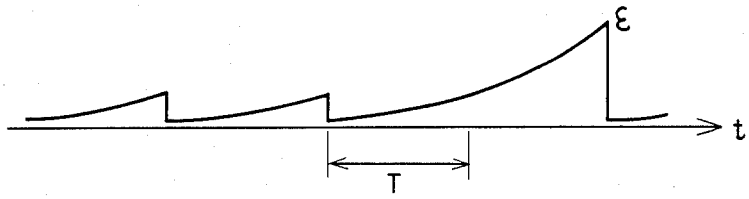
FIGS. 4 and 5 are drawings for explaining the characteristic change and correcting operation of an intake sensor in the fuel control device of the present invention.

The characteristic change of the intake sensor increases with the operating time as shown in FIG. 5, and the initial characteristics are nearly recovered by burn-off done during a stop of engine operation. Repeating this may progressively increase the characteristic change for a prolonged period.

Since the characteristic change varies as described above, an extremely prolonged time of continuous operation is not desirable because the content CLi of the aforesaid memories will be renewed if tbere takes place an acute temporary change in the characteristics, producing an excess correction value.

It, therefore, is reasonable to prohibit the aforesaid renewal of the content CLi of memory when oepration has exceeded a specific time T. The specific time T should preferably be determined in accordance with engine speed or the amount of mixture taken in, because the renewal can be prohibited within a reasonable period of time even under such operating conditions that the rate of characteristic change is extremely high.

Considering the progress of the characteristic change with a cumulative value of the amount of mixture taken in, the renewal of CLi can effectively be prohibited when the cumulative value of amount of mixture taken in, or a cumulative member of revolutions of an engine related thereto, has reached a specific value, or when the memory has been re-written for a specific number of times.

Therefore, when the burn-off of the intake sensor is done with the engine stopped, the acute temporary characteristic change previously stated will recover, hence it is reasonable to release the prohibition of CLi.

Figure 6:
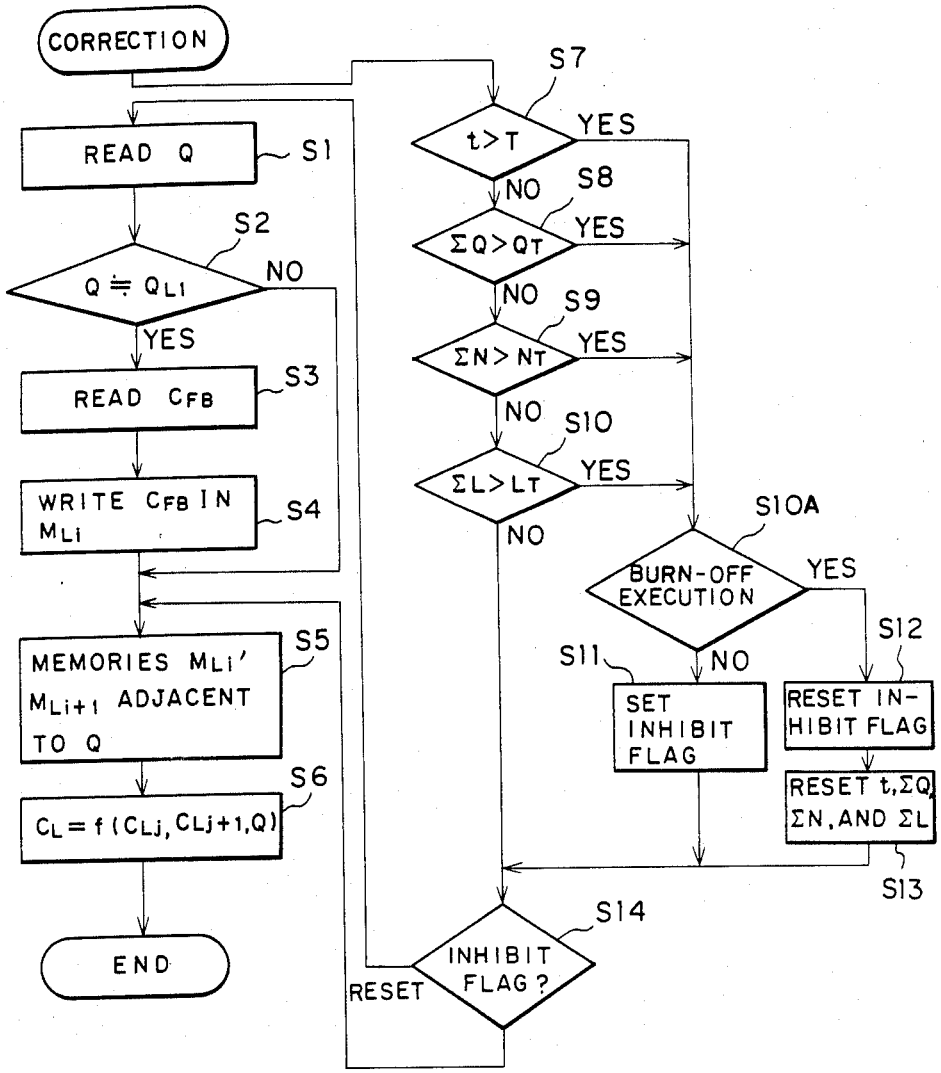
FIG. 6 is a flowchart for explaining another embodiment of the present invention.

FIG. 6 shows another embodiment of the present invention with the aforementioned taken into consideration. In the drawing, Steps S1 to S6 are similar to those in FIG. 3 and therefore their description is omitted here. Step S7 is for deciding whether the operating time t of engine is greater tan the specific time T in FIG. 5; Step S8 is for deciding whether the integral value $\Sigma Q$ of the quantity of mixture taken in is greater than a specific value QT; Step S9 is for deciding whether the integral number of revolutions $\Sigma N$ of engine is greater than a specific value NT; and Step S10 is for deciding whether an integral distance traversed $\Sigma L$ is greater than a specific value LT; when NO at all four of steps S7 through S10, the processing will proceed to Step S14. If YES in any one of the steps, a decision will be made at Step 10A on whether the execution of burn-off is required. Furthermore, in case of NO, a prohibition flag will be set, thus proceeding to Step S14. When the burn-off has been executed, the prohibition flag is reset at Step S12 and the integral values of t, $\Sigma Q$, $\Sigma N$ and $\Sigma L$ are reset at Step S13 to restart integration, then proceeding to step S14. It goes without saying that T, QT, NT and LT are determined corresponding to the time T in FIG. 5. At Step S14, the prohibition flag condition is judged; if it is in a reset state, the processing will proceed to Step S1, carrying out the correcting operation as described in FIG. 3. If the prohibition flag is in a set state, the processing will proceed to Step S5; and therefore no rewriting of the memory MLi will be executed, and the correction value CL will be calculated at Steps S5 and S6 on the basis of values previously stored.

The fuel control device, being such constituted, prevents the occurrence of an excessive correction value when the engine is run continuously for an extremely long period of time, and, at the same time, enables the renewal of the correction value again when the burn-off has been executed, thus obtaining a constantly proper value of correction.

In FIG. 6, Steps S7 to S10, having an equivalent significance, can obtain a similar effect in at least one of the steps.

According to the present invention, as described above, the amount of air-fuel ratio negative feedback is stored in a corresponding memory at a flow rate point representing the characteristic change of the intake sensor or in the vicinity thereof, and a correction value is calculated by interpolation or extrapolation operation from the content of the memory and the current quantity of mixture taken in, thereby correcting the basic controlled variable of fuel. Therefore, a good controlled condition can be obtained despite of the characteristic change of the intake sensor.

Memories storing correction values can be held to a mminimum by selecting least flow rate points representing the characteristic change or their vicinity.

Furthermore, a correction value can be produced correspondingly to a region of a lowest operation frequency by selecting a representative point in a region of high operation frequency, and also a nearly proper correction value can be employed in a flow-rate region where the air-fuel rate negative feedback is not executed.

In addition, in the event of an excessive, temporary change in the characteristics due to an extremely prolonged period of continuous operation, the renewal of the correction value is prohibited and consequently an excess correction value will never occur.

What is claimed is:

1. A fuel control device for internal-combustion engines, comprising:

(a) a fuel supply means for supplying fuel to an internal-combustion engine in accordance with the operation of a fuel control valve;

(b) a hot-wire intake sensor provided in an intake passageway of said internal-combustion engine; for sensing the amount of air being drawn in;

an air-fuel ratio sensor disposed in an exhaust pipe of said internal-combustion engine; and (c) a fuel control means which calculates the amount of fuel required by said internal-combustion engine on the basis of the output of said hot-wire intake sensor, and controls said control valve to control said fuel supply means so as to supply the fuel to said internal-combustion engine, and, at the same time, receives the output of said air-fuel ratio sensor to provide negative feedback to compensate for change in characteristic of said hot-wire intake sensor; said fuel control means including:

(i) memories and a writing means for writing in corresponding memories an amount of feedback correction corresponding to the output of said intake sensor at selected representative points, and (ii) a correction means for correcting the setting of said control valve by interpolation operation from the output of said intake sensor and the content of memories corresponding to said representative points.

2. A fuel control device as claimed in claim 1, in which the representative points of output of said intake sensor are selected to correspond to the tendency of a change in output of said intake sensor with time.

3. A fuel control device as claimed in claim 1, in which said fuel control means stops rewriting memory after the establishment of at least one of a plurality of conditions including when a specific time has elapsed after the starting of engine operation, when an integral value of the amount of mixture taken in has reached a specified amount and when an integral number of revolutions of said internal-combustion engine or a distance traversed has reached a specific value.

4. A fuel control device as claimed in claim 3, in which said fuel control means releases the stop of memory rewriting after cleaning a hot-wire surface by heating up a hot wire of the hot-wire intake sensor over normal operating temperature after the engine has stopped.

* * * * *

UNITED STATES PATENT AND TRADEMARK OFFICE

CERTIFICATE OF CORRECTION

PATENT NO. : 4,817,573

DATED : April 4, 1989

INVENTOR(S) : Toshihiro Yamada et al.

It is certified that error appears in the above-identified patent and that said Letters Patent is hereby corrected as shown below:

Column 2, line 50, "ofo" should be --of--.

Column 4, line 20, "tbere" should be --there--;

line 35, "member" should be --number--;

line 48, "tan" should be --than--.

Column 5, line 30, "mminimum" should be --minimum--.

Column 6, line 48, after claim 4, add the following claim 5:

--5. A fuel control device as claimed in claim 2, in which said fuel control means stops rewriting memory after the establishment of at least one of conditions including when a specific time has elapsed after the starting of engine operation, when an integral value of the amount of mixture taken in has reached a specific amount, when an integral number of revolutions of engine or a distance traversed has reached a specific value, and when a memory rewriting frequency has reached a specific value.--.

Signed and Sealed this

Seventeenth Day of April, 1990

*Attest:*

HARRY F. MANBECK, JR.

*Attesting Officer*

*Commissioner of Patents and Trademarks*